US006685372B1

(12) United States Patent
Foss et al.

(10) Patent No.: US 6,685,372 B1
(45) Date of Patent: Feb. 3, 2004

(54) APPLICATOR FOR APPLYING GRIP-ENHANCING SUBSTANCES TO AN OBJECT

(75) Inventors: Walter W. Foss, 324 Candlewood Trail, Cary, IL (US) 60013; Joseph V. Szczepaniak, Omaha, NE (US)

(73) Assignee: Walter W. Foss, Cary, IL (US)

( * ) Notice: Subject to any disclaimer, the term of this patent is extended or adjusted under 35 U.S.C. 154(b) by 0 days.

(21) Appl. No.: 10/424,229

(22) Filed: Apr. 25, 2003

(51) Int. Cl.[7] ..... A46B 15/00
(52) U.S. Cl. ..... 401/9; 401/10
(58) Field of Search ..... 401/9, 10, 11, 401/196; 15/104.93

(56) References Cited

U.S. PATENT DOCUMENTS 4,914,832 A * 4/1990 Cuthbert ..... 34/354
4,934,066 A * 6/1990 Rose ..... 34/333
4,953,999 A * 9/1990 Rivers ..... 401/9
5,094,557 A * 3/1992 Nelson et al. ..... 401/11

* cited by examiner

*Primary Examiner*—David J. Walczak
(74) *Attorney, Agent, or Firm*—Thomte, Mazour & Niebergall; Dennis L. Thomte

(57) ABSTRACT

An applicator for applying a grip-enhancing substance onto the grip or handle of an object such as a golf club, tennis racquet, hockey stick, hammer, etc. The grip or handle of the object is inserted into the applicator by way of a selectively closable opening formed in one end thereof. The applicator is then squeezed to transfer a grip-enhancing substance contained within the applicator onto the grip or handle. The grip or handle is then removed from the interior of the applicator.

21 Claims, 4 Drawing Sheets

APPLICATOR FOR APPLYING GRIP-ENHANCING SUBSTANCES TO AN OBJECT

BACKGROUND OF THE INVENTION

1. Field of the Invention

This invention relates to an applicator for applying grip-enhancing substances to a grip or handle such as found on a baseball or softball bat, tennis racquet, hockey stick, golf club, etc., or to the grip or handle of a hammer, etc. More particularly, the present invention relates to an applicator which is convenient to use and which will remain functional for a fairly long period of time.

2. Description of the Related Art

The grips or handles on baseball or softball bats, tennis racquets and golf clubs may become slippery during use which makes it difficult for the player to securely grasp the same. This is especially true during the summer months when the player's hands become sweaty. Pine tar rags have long been used to apply a tacky substance to the handles of baseball and softball bats but those pine tar rags are inconvenient to use and are even more difficult to store between usages. Players have also used sticky or tacky materials on the grips or handles of sports equipment with those materials being contained within an aerosol can, jar, etc.

To date, it is not believed that an applicator has been provided for applying grip-enhancing substances to the grips or handles of sports equipment which is convenient to use and which may be conveniently stored between usages. U.S. Pat. No. 5,492,425 discloses an applicator for grip-enhancing substances wherein a split tubular member is provided with the interior of the applicator containing the grip-enhancing substance. Although the applicator of the '425 patent may function, the fact that the interior thereof is open may result in an accumulation of debris therein which Will interfere with the effectiveness of the applicator. In an apparent effort to solve the problem of debris such as dust, dirt, insects, grass clippings or leaves collecting within the applicator of the '425 patent, the inventors therein state that the slit 16 may be omitted. However, the open ends of the tubular member of the '425 patent will still permit debris to enter the interior of the applicator. Further, the openness of the applicator of the '425 patent may permit the grip enhancing substance in the applicator to evaporate or dry out. Additionally, there is no teaching in the '425 patent as to the manner of conveniently attaching the applicator to a golf bag, golf cart, clothing bag, etc.

SUMMARY OF THE INVENTION

An applicator is provided for applying grip-enhancing substances onto the grip or handle of an object such as a baseball or softball bat, tennis racquet, golf club, hammer, etc. The applicator comprises an elongated, hollow outer tubular member fabricated from a flexible material. An elongated, hollow intermediate tubular member is positioned within the outer tubular member and is also fabricated from a flexible material which is liquid-impervious. An elongated, hollow inner tubular member is positioned within the intermediate tubular member and is preferably comprised of layers of flexible absorbent material such as gauze. First and second end caps close the opposite ends of the outer tubular member with the second end cap having a selectively closeable opening formed therein through which the grip or handle may be inserted. A grip-enhancing substance is impregnated in the inner tubular member so that the substance will be transferred onto the grip or handle of the object positioned within the inner tubular member when the outer, intermediate and inner tubular members are squeezed towards the grip or handle.

It is a principal object of the invention to provide an improved applicator for applying a grip-enhancing substance to the grip or handle of a baseball or softball bat, hockey stick, racquet, golf club, or to an object such as a hammer, etc.

Yet another object of the invention is to provide an improved applicator for applying a grip-enhancing substance to the handle or grip of an object wherein means is provided for preventing the collection of debris therein.

Yet another object of the invention is to provide an improved applicator for applying a grip-enhancing substance to the handle or grip of an object wherein means is provided for preventing the grip-enhancing substance therein from evaporating or drying out.

Yet another object of the invention is to provide an improved applicator for applying a grip-enhancing substance to the handle or grip of an object wherein means is provided for conveniently attaching the same to a golf bag, cart, etc.

Yet another object of the invention is to provide an improved applicator for applying a grip-enhancing substance to the handle or grip of an object wherein the applicator is convenient to use.

Yet another object of the invention is to provide an improved applicator for applying a grip-enhancing substance to the handle or grip of an object wherein the applicator is refined in appearance and durable in use.

These and other objects will be apparent to those skilled in the art.

BRIEF DESCRIPTION OF THE DRAWINGS

FIG. 3 is a sectional view of the applicator of this invention being squeezed around the grip of a golf club or the like;

DESCRIPTION OF THE PREFERRED EMBODIMENT

Figure 1:
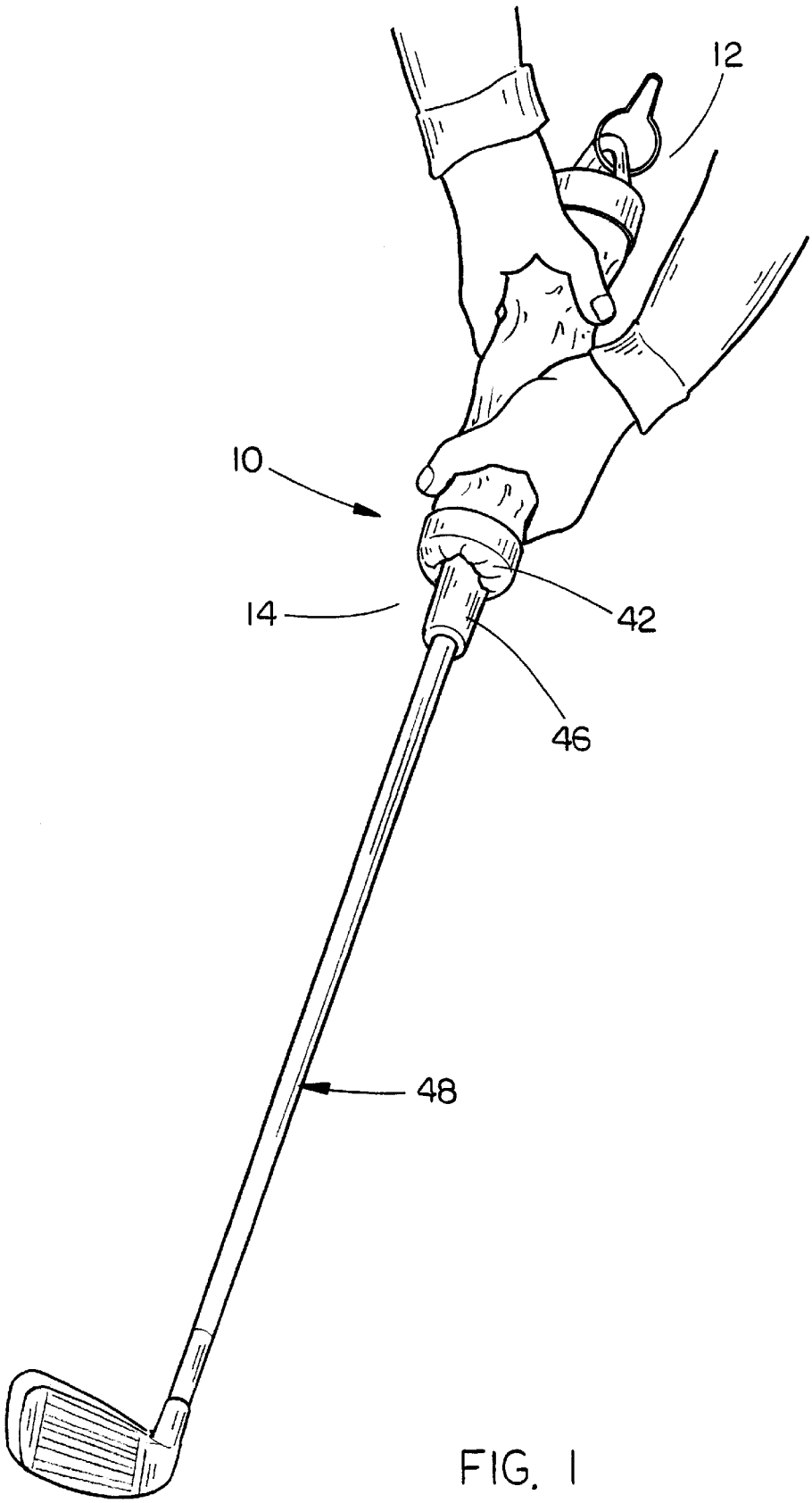
FIG. 1 is a perspective view of the applicator of this invention being used to apply a grip-enhancing substance to the grip of a golf club.

The applicator of this invention is referred to generally by the reference numeral 10 and will be described as including opposite ends 12 and 14. Applicator 10 includes an outer tubular member 16 have an outer surface 18 and inner surface 20. Tubular member 16 is comprised of a flexible fabric material such as Corduna™ which is preferably liquid impervious or waterproof so that water will not pass therethrough if the applicator is exposed to rain and so that the grip-enhancing substance within the applicator will not migrate therethrough to the exterior surface thereof.

An intermediate tubular member 22 is positioned within outer tubular member 16 and includes opposite ends. Tubular member 22 is flexible and is preferably comprised of a closed cell foam material such as urethane or Styrofoam.

Preferably, the length of intermediate tubular member 22 is the same as the length of outer tubular member 16. An inner tubular member 28 is positioned within the interior of intermediate tubular member 22 and is comprised of a flexible, absorbent gauze material. Preferably, inner tubular member 28 is comprised of a plurality of layers of gauze material which are secured to the intermediate tubular member by stitching 30 or the like. Inner tubular member 28 is impregnated with a grip-enhancing substance as will be described in greater detail hereinafter. Although not necessary, it is recommended that the length of inner tubular member 28 be less than the length of intermediate tubular member 22.

Annular rigid reinforcing rings 32 are positioned within the opposite ends of intermediate tubular member 22, respectively, and are maintained therein by a suitable adhesive material. A plastic end cap 36 is mounted on the applicator 10 at end 12 thereof to close one end of the applicator 10. Connector 38 in the form of an eye extends from end cap 36 to provide a convenient means for attaching the applicator to a golf bag or cart, equipment bag, etc. End 14 of applicator 10 has a plastic end cap 40 secured thereto which selectively closes that end of the applicator. End cap 40 has a selectively closable opening 42 formed therein by way of intersecting slits 44. The grip or handle of the object being enhanced may pass through the selectively closable opening 42, as illustrated in FIG. 1, wherein the grip 46 of a golf club 48 has been inserted into the interior of the applicator 10.

As stated, the inner tubular member 28 is preferably comprised of a gauze material which is impregnated with a grip-enhancing substance. The substance employed with the applicator is a polyethylene wax which is approximately C42, or a molecular weight of ca. 580. The commercial use of this substance is that of sealing, weatherproofing or protecting meat in the meat packing business. The grip-enhancing substances disclosed in U.S. Pat. No. 5,492,425 will also work in the applicator of this invention.

Figure 3:
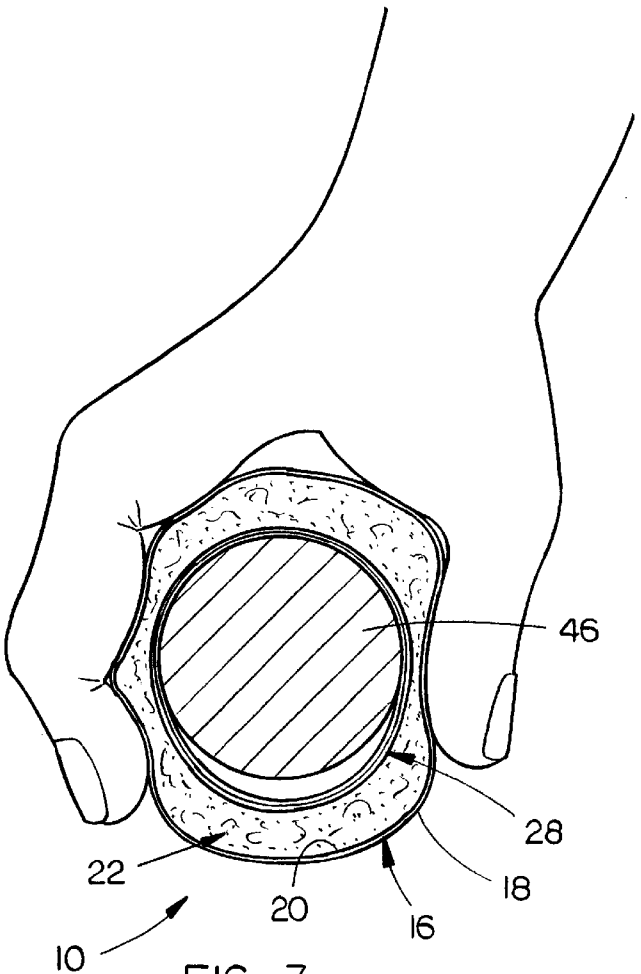
Figure 2:
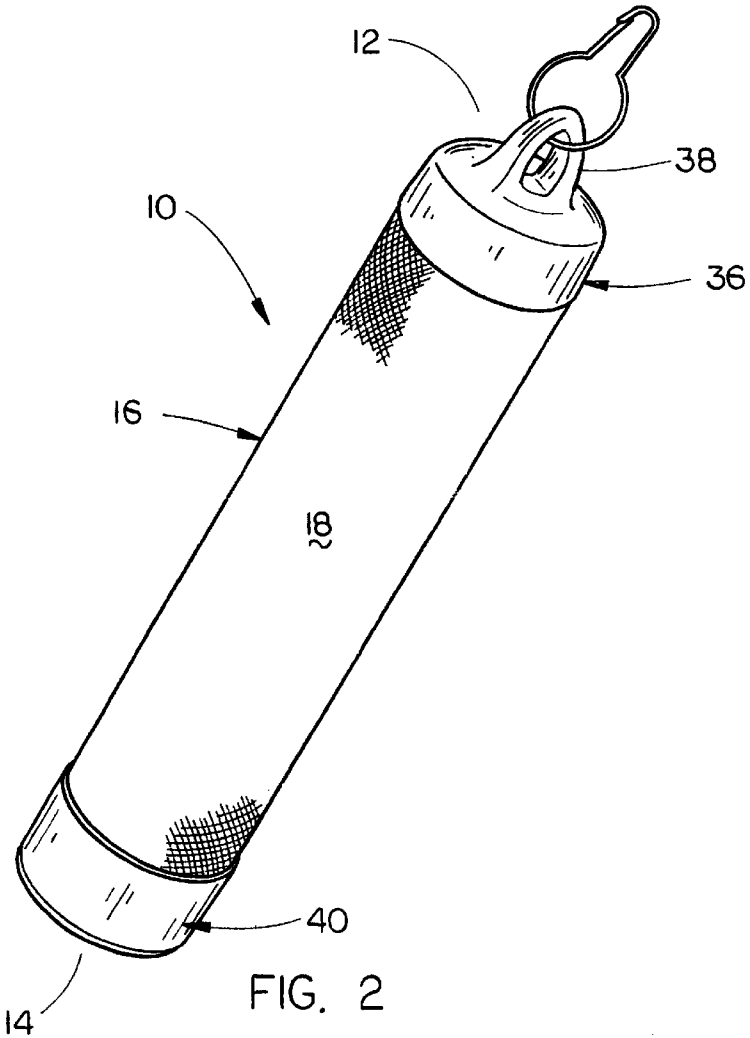
FIG. 2 is a perspective view of the applicator of this invention.
Figure 4:
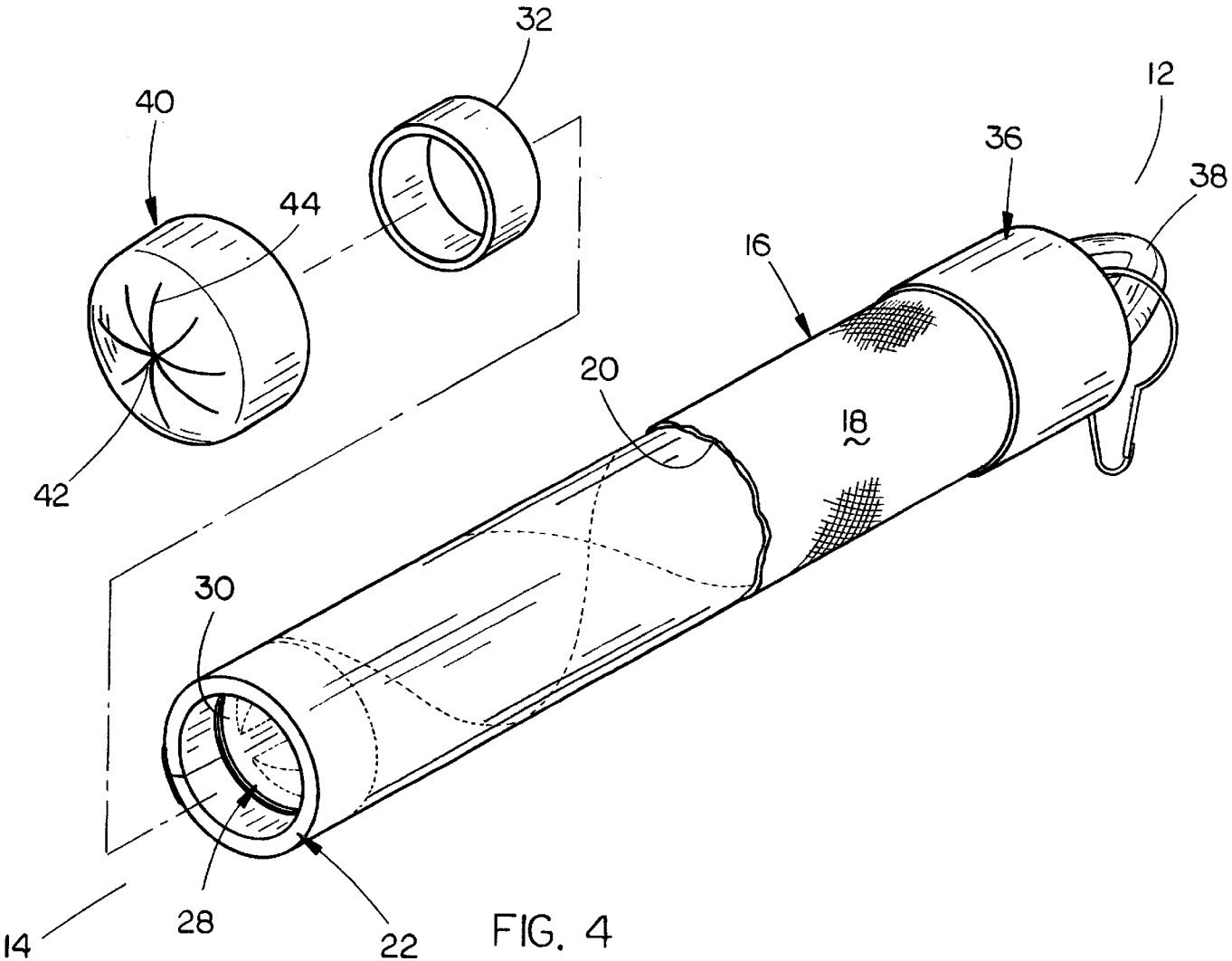
FIG. 4 is a partial exploded perspective view of the applicator of this invention.
Figure 5:
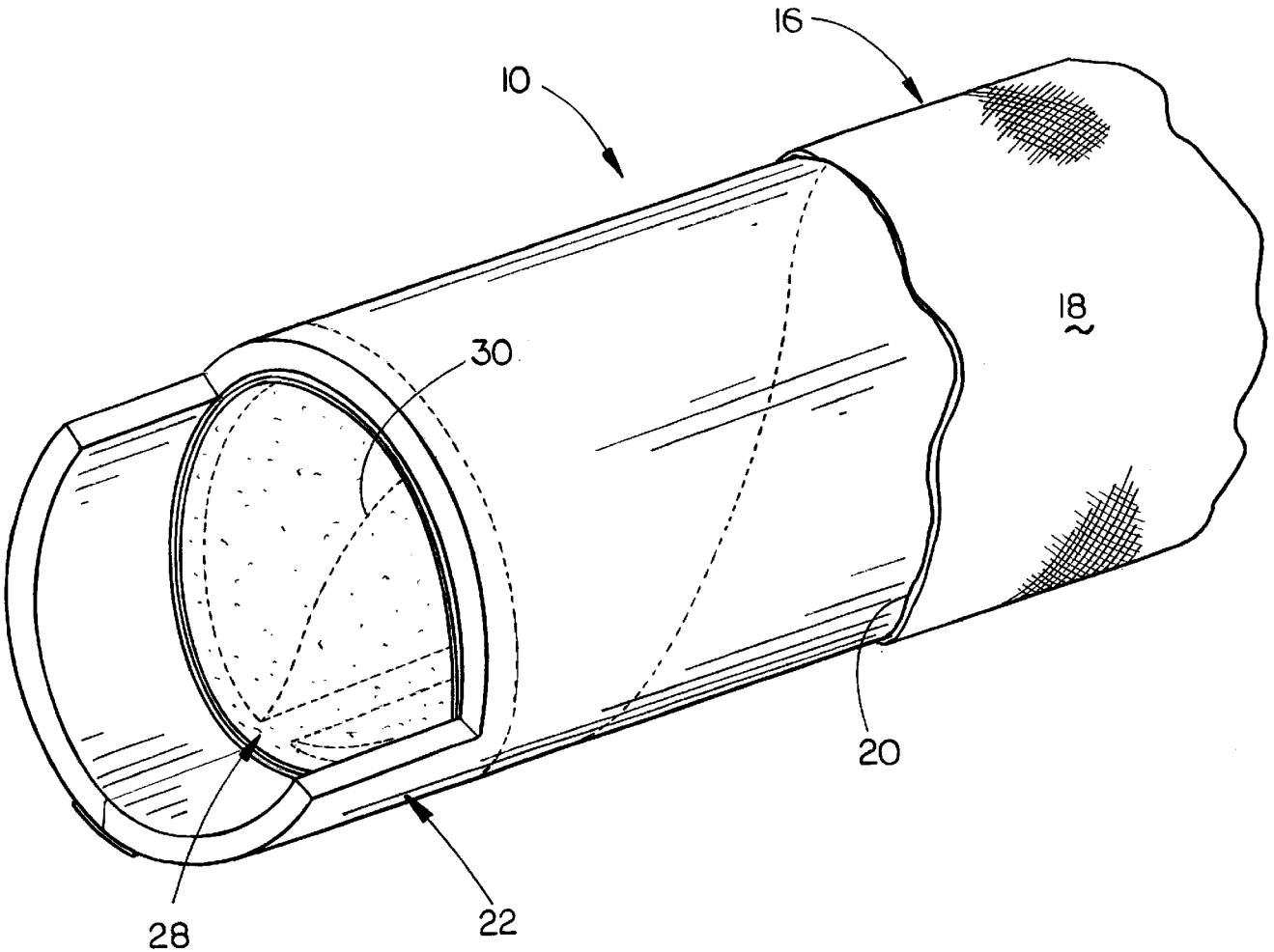
FIG. 5 is a partial perspective view of the applicator of this invention with portions thereof cut away to more fully illustrate the invention.

In use, the applicator 10 may be secured to a golf bag, cart, sports bag, etc. The end caps 36 and 40 prevent debris from entering the interior of the applicator and prevent the grip-enhancing substance impregnated in the inner tubular member 28 from drying out. When it is desired to enhance the grip of an object, such as the grip 46 of golf club 48, the grip 46 thereof is inserted through the selectively closable opening 42 into the interior of inner tubular member 28. When the grip has been so positioned, as illustrated in FIG. 1, the applicator 10 is squeezed to bring the inner tubular member 28 into contact with the grip 46 to transfer a portion of the grip-enhancing substance in the inner tubular member 28 onto the grip 46 of the golf club 48, as seen in FIG. 3. After the applicator 10 has been sufficiently squeezed around the grip to transfer the grip-enhancing substance to the entire outer surface of the grip, the club or object is then removed from the applicator. Although it is preferred that outer, intermediate and inner tubular members be employed in the applicator, it may be possible to omit the intermediate tubular member providing the outer tubular member is liquid-impervious and the inner layer is positioned in the interior of the outer tubular member.

Thus it can be seen that an applicator for grip-enhancing substances has been provided which is convenient to use, is durable in use and which accomplishes at least all of its stated objectives.

We claim:

1. An applicator for applying grip-enhancing substances on the grip or handle of an object, comprising:

an elongated, hollow outer tubular member having first and second ends;

said outer tubular member being comprised of a flexible material;

an elongated, hollow intermediate tubular member, having first and second ends, positioned within said outer tubular member;

said intermediate tubular member being comprised of a flexible, liquid-impervious material;

an elongated, hollow inner tubular member, having first and second ends, positioned within said intermediate tubular member;

said inner tubular member being comprised of a flexible absorbent material;

a first end cap closing said first end of said outer tubular member;

a second end cap selectively closing said second end of said outer tubular member;

said second end cap having a selectively closable opening formed therein through which the grip or handle of the object may pass;

and a grip-enhancing substance in contact with said inner tubular member which is transferable onto the grip or handle of the object positioned within said inner tubular member when said outer, intermediate and inner tubular members are squeezed towards the grip or handle within said inner tubular member.

2. The applicator of claim 1 wherein said intermediate tubular member is comprised of a closed cell material.

3. The applicator of claim 2 wherein said closed cell material comprises a Styrofoam material.

4. The applicator of claim 1 wherein said outer tubular member is comprised of a fabric material.

5. The applicator of claim 1 wherein said inner tubular member is secured to said intermediate tubular member.

6. The applicator of claim 1 wherein said inner tubular member is comprised of a gauze material.

7. The applicator of claim 1 wherein said inner tubular member is comprised of a plurality of layers of gauze material.

8. The applicator of claim 1 wherein said grip-enhancing substance is impregnated in said inner tubular member.

9. The applicator of claim 1 wherein said first end cap has a connector element thereon.

10. The applicator of claim 1 wherein said first end cap is comprised of a plastic material and wherein a rigid annular ring is positioned therein.

11. The applicator of claim 1 wherein said second end cap is comprised of a plastic material and wherein a rigid annular ring is positioned therein.

12. The applicator of claim 1 wherein said selectively closable opening is formed by a plurality of intersecting slits.

13. The applicator of claim 1 wherein said inner tubular member has a length less than that of said intermediate tubular member.

14. An applicator for applying grip-enhancing substances to the grip or handle of an object, comprising:

an elongated, hollow outer tubular member having first and second ends;

said outer tubular member being comprised of a flexible material;

said outer tubular member being comprised of a liquid-impervious material;

an elongated, hollow inner tubular member, having first and second ends, positioned within said outer tubular member;

said inner tubular member being comprised of a flexible absorbent material;

a first end cap closing said first end of said outer tubular member;

a second end cap selectively closing said second end of said outer tubular member;

said second end cap having a selectively closable opening formed therein through which the grip or handle of an object may pass;

and a grip-enhancing substance in contact with said inner tubular member which is transferable onto the grip or handle positioned within said inner tubular member when said outer and inner tubular members are squeezed towards the grip or handle within said inner tubular member.

15. The applicator of claim 14 wherein said inner tubular member is comprised of a gauze material.

16. The applicator of claim 14 wherein said inner tubular member is comprised of a plurality of layers of gauze material.

17. The applicator of claim 14 wherein said grip-enhancing substance is impregnated in said inner tubular member.

18. The applicator of claim 14 wherein said first end cap has a connector element thereon.

19. The applicator of claim 14 wherein said first end cap is comprised of a plastic material and wherein a rigid annular ring is positioned therein.

20. The applicator of claim 14 wherein said second end cap is comprised of a plastic material and wherein a rigid annular ring is positioned therein.

21. The applicator of claim 14 wherein said selectively closable opening is formed by a plurality of intersecting slits.

* * * * *